United States Patent [19]

Hills et al.

[11] 3,965,642

[45] June 29, 1976

[54] METHOD AND APPARATUS FOR FILLING PLASTIC BAGS WITH LIQUID OR PARTICULATE MATERIAL

[75] Inventors: William H. Hills; Shirley M. Hills, both of Melbourne Village, Fla.

[73] Assignee: Hills Research & Development, Inc., Melbourne, Fla.

[22] Filed: Aug. 22, 1974

[21] Appl. No.: 499,558

[52] U.S. Cl. ..... 53/28; 53/29; 53/180 M; 53/183

[51] Int. Cl.[2] ..... B65B 9/08

[58] Field of Search ..... 53/28, 29, 22 B, 180, 53/183

[56] References Cited

UNITED STATES PATENTS

| | | | |
|---|---|---|---|
| 3,299,603 | 1/1967 | Shaw | 53/22 B |
| 3,389,534 | 6/1968 | Pendleton | 53/180 |
| 3,495,992 | 2/1970 | DeFor | 53/29 X |
| 3,561,186 | 2/1971 | Pickering | 53/22 B |

*Primary Examiner*—Travis S. McGehee
*Attorney, Agent, or Firm*—Rose & Edell

[57] ABSTRACT

Formation and liquid-filling of plastic bags is performed in a continuous high speed and low cost process. Plastic film is extruded in tubular form and inflated with air or another gas. The tube is transported along a path of work stations at which the tube is successively: sealed to define a series of inflated sections; filled with liquid, while inflated, by a large size hypodermic-type needle configured to puncture and displace entrapped gas with fill liquid, the displaced gas escaping around the needle; seamed to seal off the needle-hole from the liquid-filled portion of the bag; and cut to separate the individual bags, if desired.

8 Claims, 6 Drawing Figures

METHOD AND APPARATUS FOR FILLING PLASTIC BAGS WITH LIQUID OR PARTICULATE MATERIAL

BACKGROUND OF THE INVENTION

The present invention relates to filling plastic bags with liquids and the like. More particularly, the present invention relates to a continuous high speed and low cost process for both forming and filling plastic bags.

The prior art is lacking in a method of liquid-filling plastic bags which is sufficiently fast and inexpensive to render it competitive with processes for filling bottles or cans. One of the major problems in this regard relates to the difficulty of gripping and holding open the bag during filling. In other words, the flimsiness of the plastic bag renders it unsuitable for high speed filling processes. In addition, it is important to avoid splattering the fill liquid onto an inside portion of the bag surface where a closure seal is to be made. Specifically, plastic film seals are usually made by heat and pressure. This may be done with heated bars, heated rollers, or with an ultrasonically-driven shoe which provides pressure and generates heat with high frequency hammering of the shoe against the plastic film which is positioned between the shoe and an anvil. In any of these sealing methods, certain liquids on either of the sealed surfaces tend to prevent proper sealing.

Still another problem related to high speed bag filling relates to spillage. Specifically, it is difficult to run a high speed process with an open-ended bag properly oriented to avoid spillage of the contained liquid. Sealing of the bag before such spillage occurs would appear to require quick movement of the open bag, and such movement itself would tend to cause spillage.

It is therefore an object of the present invention to provide a high speed, low cost process for filling plastic bags with liquid or liquid-like material.

It is another object of the present invention to provide a high speed method of bag filling in which the fill liquid cannot impair the bag closure seal.

Another object of the present invention is to provide a high speed process of liquid-filling plastic bags wherein spillage problems are avoided.

SUMMARY OF THE INVENTION

In accordance with the present invention, a film of plastic in tubular form is inflated with gas and transported to successive work stations. First the tube is sealed to define successive connected and inflated bags. Next a hypodermic type filler nozzle punctures each bag and displaces the gas with fill liquid, the displaced gas being forced out of the bag around the nozzle periphery. Each bag is then seamed to isolate the nozzle puncture from the portion of the bag containing liquid. Optionally, the bags may then be separated or they may be packed and shipped while linked together.

Because each bag is filled when in an inflated and completely sealed condition, the bags may be easily and quickly handled, transported and filled without imparing the seal and without spillage.

BRIEF DESCRIPTION OF THE DRAWINGS

The above and still further objects, features and advantages of the present invention will become apparent upon consideration of the following detailed description of specific embodiments thereof, especially when taken in conjunction with the accompanying drawings, wherein.

DESCRIPTION OF PREFERRED EMBODIMENTS

Figure 1:
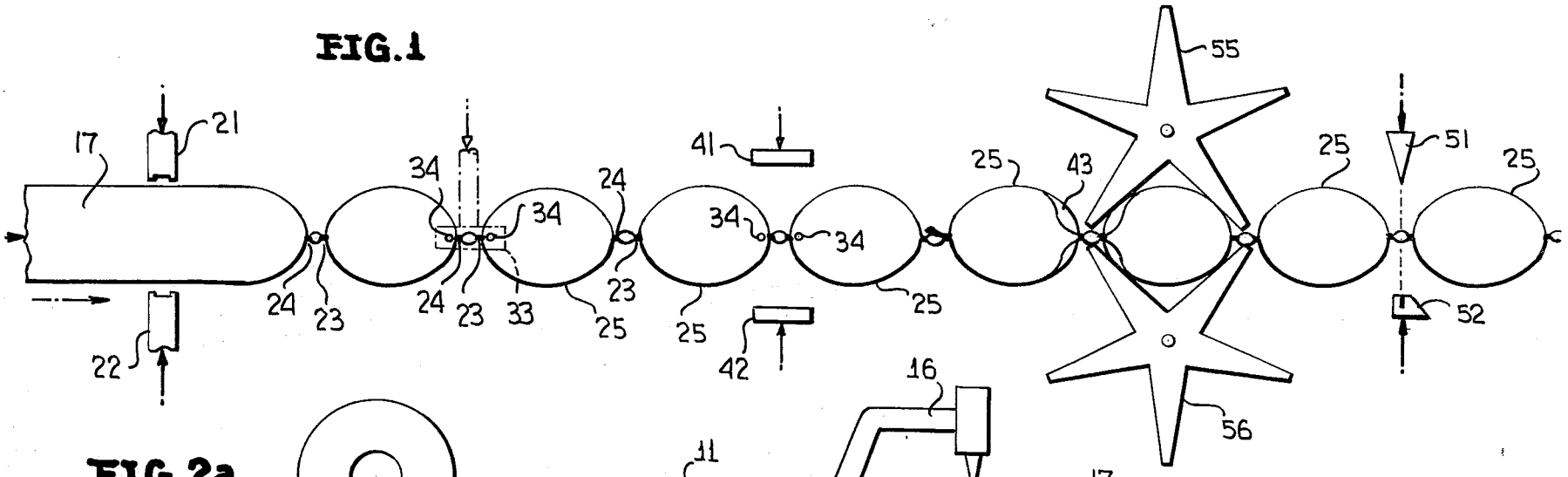
FIG. 1 schematically illustrates the top view of a series of stations for performing the process of the present invention.
Figure 2A:
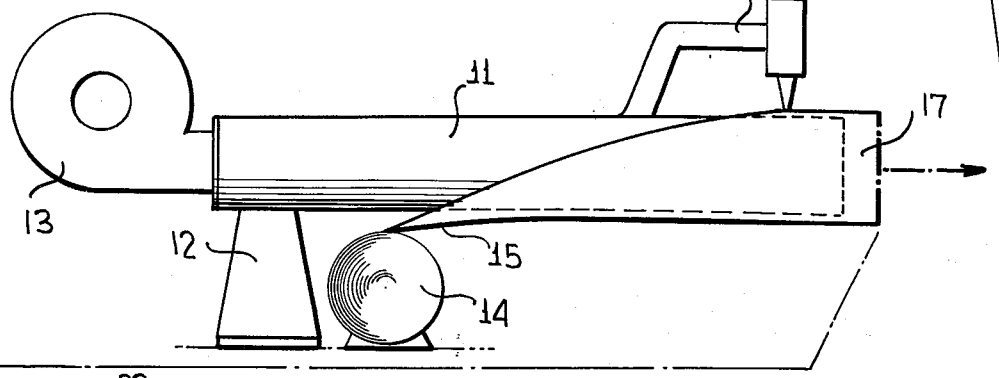
FIG. 2*a* schematically illustrates the formation and inflation of the plastic tube used in FIGS. 1 and 2.
Figure 2:
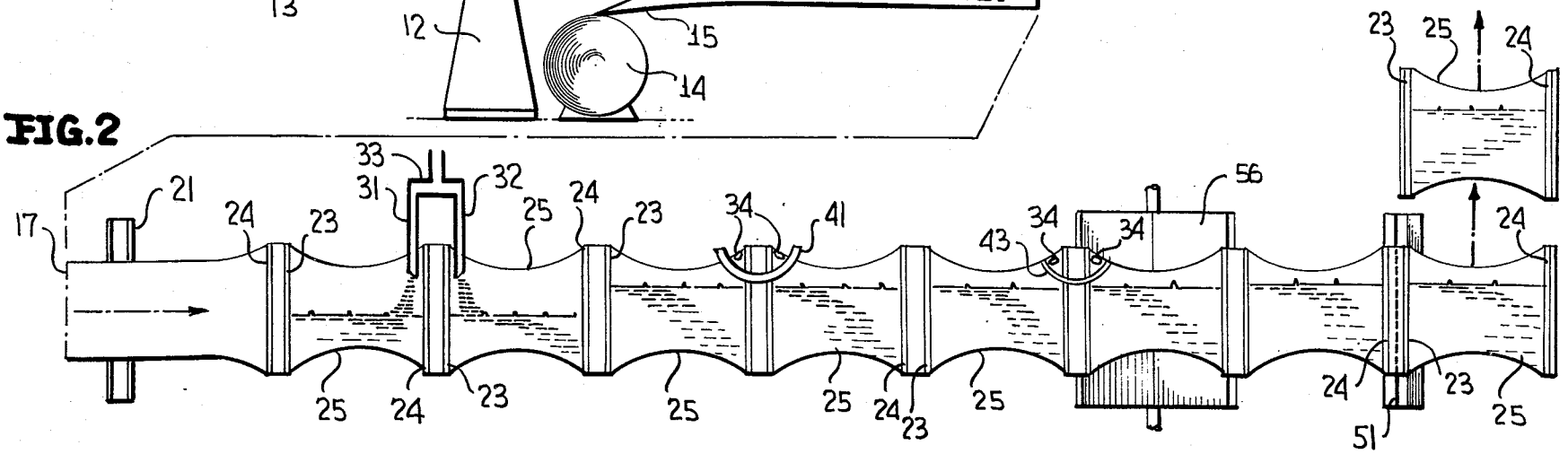
FIG. 2 schematically illustrates a side view of the stations of FIG. 1.

Referring specifically to FIGS. 1, 2 and 2*a* of the accompanying drawings, a high speed process for liquid-filling plastic bags is diagrammatically illustrated. A mandrel 11, in the form of a hollow cylindrical member, is supported in a generally horizontal orientation by support 12. A blower 13 delivers pressurized gas, most usually air, to one end of the mandrel interior to establish flow through the mandrel and out the other end. A feed roll 14 of flat plastic film 15, for example polyurethane, is positioned adjacent mandrel 11 so as to pay out the plastic film in a direction toward the downstream end of the mandrel. A conventional seam-forming apparatus, such as an ultrasonic seam welder 16, is mounted on or adjacent mandrel 11 to effect a seaming operation which joins opposite edges of film 15. Specifically, film 16, after being paid out by feed roll 14, is wrapped about the mandrel so that opposite sides of the film may be overlapped. The overlapped edges pass between the head of seam welder 16 and the surface of mandrel 11 so that a seam may be formed which configures the film as a tube 17. The pressurized air emitted from the downstream end of mandrel 11 inflates the thusly formed plastic tube. Tube 17 then proceeds to a series of bag-forming and liquid-filling stations to be described. Instead of being seam-welded from flat film, the inflated tube 17 may come directly from a conventional blown film extruder, making seaming unnecessary.

The inflated plastic tube 17 first passes a bagforming station at which seaming apparatus such as conventional hot seaming bars 21, 22 are located. Bars 21 and 22 are positioned on opposite sides of tube 17 and are actuable to move toward one another whereupon to apply the pressure and heat necessary to effect two closely-spaced pressure-sealing seams 23, 24 across the tube. Each pair of seams 23, 24 thusly formed defines adjacent ends of two inflated plastic bags. In this manner a series of connected platic bags 25 are formed and are transported to the filling station described below.

The filling mechanism at the filling station includes a pair of large, hypodermic nozzles 31, 32. The nozzles are fed liquid from a supply tank (not shown) via a manifold 33. Nozzles 31, 32 extend radially downward toward bags 25 and are normally displaced therefrom. The spacing between the nozzles is such that each punctures a corner of a respective inflated bag 25 proximate the seams. Nozzles 31, 32 are preferably sharpened at their tips in order to make only a very small hole 24 in the bags. The relatively dull tapered section of the nozzle, above the nozzle tip, then forces its way through the plastic film, producing local stretching of the film which creates a good seal against loss of inflation. Other types of puncture-facilitating techniques may be used, such as heating the nozzle tip. After the nozzles have entered bags 25, fill liquid begins to flow to manifold 33 and is admitted into the bags through the nozzles. The fill liquid flow continues until a predetermined volume of liquid has entered each bag. The entering liquid displaces the air in the bag which is forced out through the puncture 34 around the periphery of the nozzle. To the extent that bag 25 is not filled to capacity with liquid it remains inflated. After liquid flow is terminated nozzles 31, 32 are withdrawn quickly and the filled bags are quickly sealed as described below.

The next station includes a pair of opposed heated clam shell-type jaws 41, 42 positioned on respective sides of the train of bags 25. When punctures 34 are properly positioned jaws 41, 42 are brought together, entrapping a portion of the bags therebetween to produce a secondary seal 43. Specifically, the jaws 41, 42 are positioned and configured to create a secondary seal 43 which isolates puncture 34 from the liquid-filled portion of the bag. In the embodiment illustrated secondary seal 43 is arcuate in shape, extending from the edge of one bag 25, across seam pair 23, 24, to the like edge of adjacent bag 25. Punctures 34 in the adjacent corners of adjacent bags 25 are trapped between secondary seal 43 and the bag edges.

In the apparatus illustrated, seaming bars 21, 22, nozzles 31, 32 and clam shell jaws 41, 42 are all slidably mounted and conventional means are provided to drive these elements in the transport direction at the same speed as the tube during the sealing, filling and re-sealing operations. Between operations, seaming, filling and re-sealing elements are driven rapidly back to their initial positions and are then re-synchronized with the tube movement to permit another sequence of sealing, filling and re-sealing. Alternatively, if seam forming of the tube is employed, the sealing, filling and re-sealing stations may remain in one place, and the tube would be indexed between operations. However, filling the bags while they are in motion permits higher machine productivity rates, a principal objective of this invention.

The liquid filled and sealed bags 25 may be packed and shipped in connected or linked form, or may be cut into individual bags. If the bags are to be cut, a suitable cutting station is provided along the transport path at which a cutter blade 51 and suitable notched anvil 52 are positioned on opposite sides of the bags. The cutter blade 51 is positioned parallel to seams 23 and 24 so that the bags may be separated between their two seams. When the bags are properly positioned such that blade 51 is between seams 23, 24, the blade is forced into the notched anvil 52 (by means not shown). The cut bag 25 may then be permitted to drop onto a suitable conveyor or into a suitable receptacle. Depending on how fast the cutter can be made to operate, it may or may not be necessary to move the cutter along with the bags while they are being cut apart.

A typical transport drive means for tube 17 and bags 25 is illustrated in the form of a pair of opposed drive wheels 55, 56. These drive wheels are positioned on opposite sides of the chain of bags to engage the bags therebetween. If bag-cutting means 51, 52 are provided, drive wheels 55, 56 are positioned to engage the bags immediately before the bags reach the cutting station. If an indexing operation is used the rollers are rotatably stepped (by means not shown) to assure proper positioning of tube 17 and bags 25 at each operation station. In the embodiment illustrated in FIG. 1 the seaming, filling and secondary seaming stations may be separated from the previous station by an even number of bag lengths to accommodate an indexing-type drive. Specifically the filling station (31, 32) is separated from the seaming stations (21, 22) by two bag lengths; the secondary seaming station (41, 42) is separated from the filling station by two bag lengths. Indexing drive wheels would be required to transport the tube 17 and bags 25 one bag length during each indexing period. Seaming bars 21, 22 would be required to operate after each indexing period; however, filling station (31, 32) and secondary seaming station (41, 42) would be actuated only after alternate indexing periods.

Drive wheels 55, 56 are illustrated in a spoked configuration to permit engagement of the bag train at seams 23, 24. Alternatively the drive wheels may be rollers with tapered hour-glass shaped drive surfaces; this configuration permits positive frictional engagement of the filled portion of the bags between the end seams without danger of bag rupture because of undue pressure exerted between the rollers. The ends of the rollers would be configured to also drive the seam portions of the bags as these portions pass between the rollers. It will be appreciated that other conventional forms of indexing drive mechanisms may be employed.

It is understood, of course, that only one bag 25 need be filled at a time, in which case only one filling nozzle would be required. The secondary seaming jaws 41, 42 would change configuration accordingly as would the mutual spacing requirements between stations in the case of an indexing drive.

Figure 3:
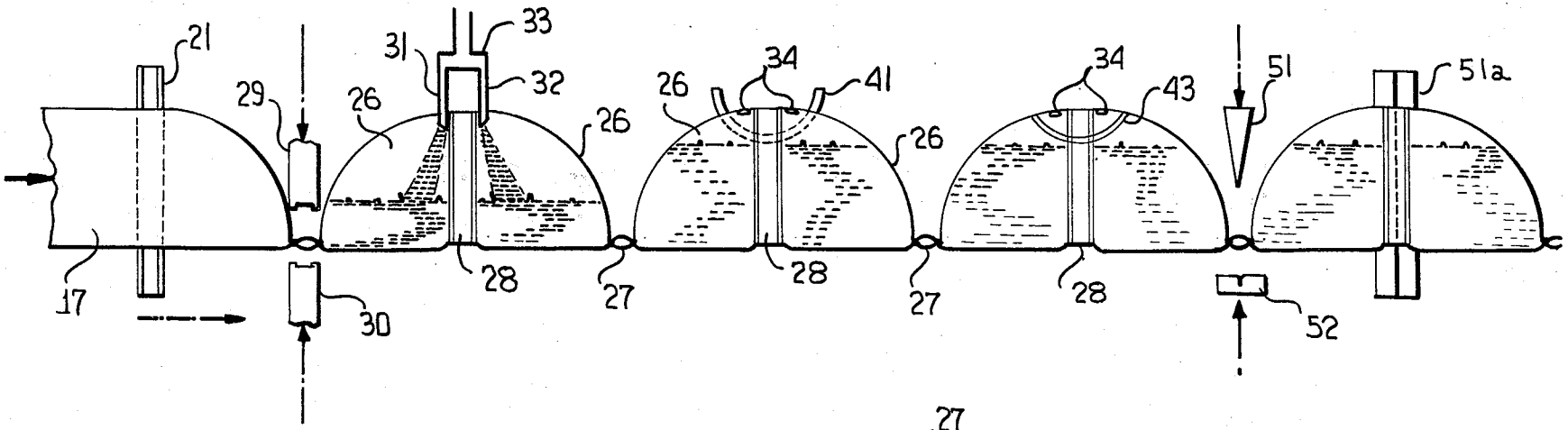
FIG. 3 schematically illustrates a side view of a series of work stations for performing an alternative process of the present invention.
Figure 4:
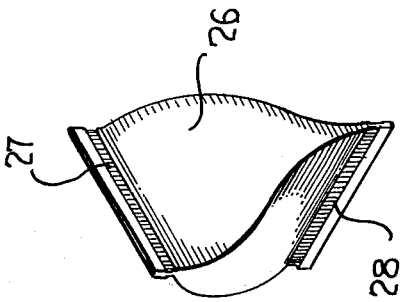
FIG. 4 is a view in perspective of a bag formed and filled according to the process illustrated in FIG. 3.

FIG. 3 illustrates an alternative process in which bags 26 having the configuration illustrated in FIG. 4 are formed and filled. Bag 26, instead of having end seams 23, 24 which are parallel to one another as in bag 25, has end seams 27, 28 which are perpendicular to one another. The process illustrated in FIG. 3 differs from that of FIGS. 1, 2 only by requiring an additional pair of primary seaming bars 29, 30 and an additional cutter 51*a* and anvil (not shown). Whereas seaming bars 21, 22 are oriented to define a pair of vertical seams 28 in tube 17, bars 29, 30 are oriented to define a horizontal seam pair 27. Likewise cutter 51*a* is vertically oriented whereas cutter 51 is horizontal. The advantage of alternate horizontal and vertical seams is that a sharper more pointed corner is provided for bag 26, permitting secondary seams 43 to be made (after filling) with less volume loss in the bag. In addition, there is less likelihood that liquid will get into the region of the secondary seam 43 during filling.

For extremely high production, an apparatus similar to a bottle filling and sealing machine would be preferable to the embodiment described above. The plastic tube would be formed, inflated, and cross seamed while in continuous motion. The linked and inflated bags thus formed would pass around a large rotating wheel with multiple peripheral pockets for respective multiple bags. For each pair of bags or pockets, a dual fill nozzle and also a dual resealer would be provided at the wheel periphery. All stations or pocket-pair locations would be identical and means would be provided to operate first the filling nozzles and then the re-sealing devices at each pocket pair as the bags progress around the wheel. Such a system is illustrated in FIG. 5.

Seamed or extruded tube 17 advances continuously to seaming wheel 57 fitted with radially extending sealer bars 58. The tube passes around continuously-driven wheel 57 and is cross-sealed at spaced locations between the ends of sealer bars 58 and corresponding sealer bars carried by conveyor chain 59. Chain 59 is supported by a shoe 61 and sprockets 62, 63, at least one of which is driven synchronously with seaming wheel 57. The sealed inflated bags are transferred from wheel 57 to filling wheel 64 which is illustrated as having twenty-four peripheral bag-receiving pockets. Wheel 64 is synchronously driven with seaming wheel 57 and is the situs of filling and re-sealing functions which, in many respects, proceed in a manner similar to a conventional bottle or can filling and sealing machine. Such machines sometimes have 100 or more stations or pockets on the main wheel and wheel 64 may, of course, include that many stations. All stations on wheel 64 are identical, each pair of pockets constituting a station and being equipped with both filling and re-sealing devices. As a pair of pockets move with the wheel into a certain zone, the filling and re-sealing devices are automatically activated by cams, air cylinders or other conventional means (not shown).

Figure 5:
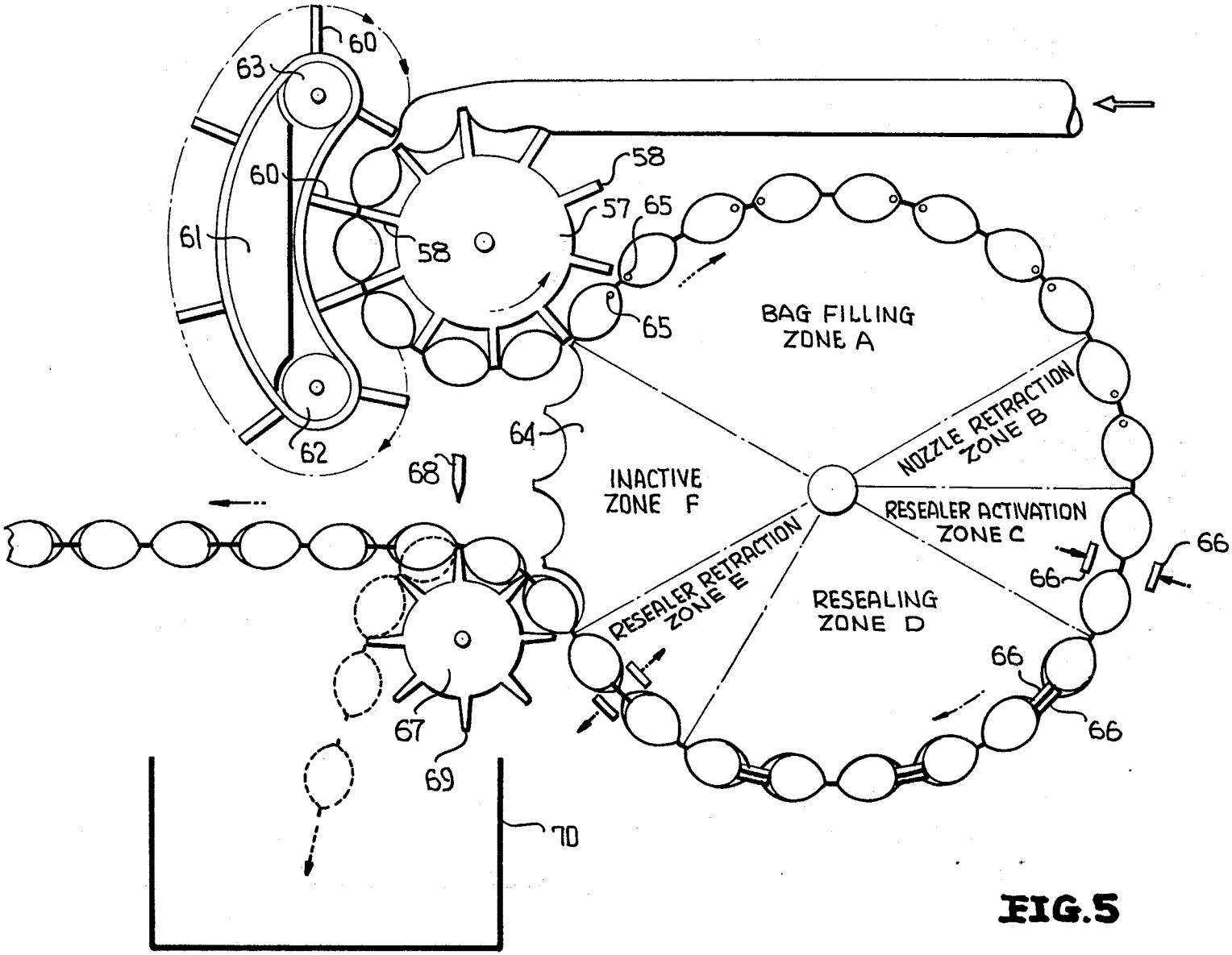
FIG. 5 is a diagrammatic illustration of another embodiment of the bag-filling process of the present invention.

As diagrammatically represented in FIG. 5, four pairs of filling needles, 65, fill the bags in "Bag Filling Zone A". In Zone B filling is stopped and the needles are retracted. In Zone C clam shell re-sealers 66 are urged inward toward the region of the bag where the punctures were made. In the next "Re-sealing Zone D" the re-seal is accomplished. In Zone E, the re-sealers are retracted. In Zone F no devices are functioning and the filled and re-sealed bags are transferred from wheel 64 to a cutter anvil wheel 67 which is also driven synchronously with wheel 57. A cutter blade 68 intermittently operates against one of the anvils 69 on wheel 67, cutting the bags apart and allowing them to drop into box 70. Alternatively, cutter 68 may be deactivated and the still-linked full bags are conveyed to a station (not shown) where they are prepared for shipment in linked form.

It should be noted that while the preferred embodiments have been described in terms of filling plastic bags with liquid, other flowable filling media such as powders, grains, and particulate matter in general may be used in place of liquid.

While we have described and illustrated specific embodiments of our invention, it will be clear that variations of the details of construction which are specifically illustrated and described may be resorted to without departing from the true spirit and scope of the invention as defined in the appended claims.

We claim:

1. A continuous high-speed method of forming and filling plastic bags comprising the steps of:

continually advancing a sheet of flexible plastic material longitudinally to a plurality of operation locations in succession;

at a first location, forming a longitudinally-sealed tube from said sheet and inflating said tube with a gaseous medium;

at a second operation location, segmenting the inflated tube into individual interconnected, inflated and pressure-isolated plastic bags by sealing the tube generally transversely at fixed intervals along its length;

at a third operation location, filling each inflated plastic bag with flowable fill media by puncturing the bag with a fill nozzle and displacing the inflating gas with fill media introduced into the bag through said nozzle, the displaced gas being permitted to escape from said bag through the puncture about the nozzle periphery; and at a fourth operation location, sealing the bag about said puncture to prevent fill media from escaping through said puncture.

2. The method according to claim 1, wherein the step of forming said tube comprises the steps of:

delivering said sheet to a generally cylindrical hollow mandrel such that the sheet is wrapped about the mandrel with its opposite longitudinal edges overlapped; and seaming the overlapped edges while on said mandrel to form said tube;

and wherein said step of inflating comprises issuing a pressurized gas into said tube from within the hollow mandrel.

3. The method according to claim 1 comprising the additional step of:

at a fifth operation location, separating the filled interconnected bags from one another.

4. The method according to claim 1 wherein said step of filling comprises:

filling a plurality of said inflated bags simultaneously with individual fill nozzles.

5. The method according to claim 1 wherein all of the seals made at said second operation location extend in a common plane.

6. The method according to claim 1 wherein successive seals made at said second operation location reside in mutually perpendicular planes.

7. Apparatus for forming bags from a tube of plastic film-like material and filling the plastic bags with flowable fill media in a high-speed, continuous process, said apparatus comprising:

means for continually advancing said tube longitudinally along a path of operation locations;

means for inflating said tube with pressurized gas;

seaming means at a first operation location for transversely sealing the inflated tube periodically to define individual interconnected, inflated and pressure-isolated plastic bags;

nozzle means operable at a second operation location for puncturing said plastic bags and displacing gas in said bag with fill media; and re-sealing means operable at a third operation location for re-sealing each bag to prevent fill media from escaping through the puncture made by said nozzle means.

8. The apparatus according to claim 7 further comprising:

means at a fourth operation station for separating the filled interconnected bags from one another.

* * * * *